United States Patent [19]

Fox

[11] Patent Number: 4,495,750

[45] Date of Patent: Jan. 29, 1985

[54] TRANSFERRING PACKETS

[75] Inventor: Austin L. Fox, London, England

[73] Assignee: Molins PLC, London, England

[21] Appl. No.: 360,522

[22] Filed: Mar. 22, 1982

[51] Int. Cl.[3] ..... B65B 19/24

[52] U.S. Cl. ..... 53/575; 53/579; 53/234; 493/172

[58] Field of Search ..... 53/575, 578, 579, 225, 53/234, 563; 493/172, 173

[56] References Cited

U.S. PATENT DOCUMENTS

| | | | |
|---|---|---|---|
| 2,304,399 | 12/1942 | Clark | 53/234 X |
| 2,603,925 | 7/1952 | Moore | 53/575 X |
| 3,572,006 | 3/1971 | Demierre | 53/575 |
| 3,910,012 | 10/1975 | Schmezmund | 53/234 |
| 4,241,564 | 12/1980 | Quarenghi | 53/575 |
| 4,330,976 | 5/1982 | Blackall | 53/234 X |

FOREIGN PATENT DOCUMENTS

| | | | |
|---|---|---|---|
| 2809577 | 9/1979 | Fed. Rep. of Germany | 53/234 |
| 328672 | 4/1958 | Switzerland | 53/234 |
| 703422 | 2/1954 | United Kingdom | 53/225 |

*Primary Examiner*—John Sipos

*Attorney, Agent, or Firm*—John C. Smith, Jr.

[57] ABSTRACT

Apparatus for transferring partly formed soft packs of cigarettes, the adhesive in whose folded bottom ends may not have fully set, comprises a pair of air cylinders 54,56 which are pivotally mounted for alternately swinging into successive open-sided pockets 20 of a drying drum 12. As a soft pack 16 on a pack-forming drum 10 is stripped off its mandrel 14 by a pusher 62, one of the two cylinders engages its bottom end and maintains slight compression of the end during transfer. Meanwhile the other cylinder is extended in readiness for the next pack to be transferred.

6 Claims, 4 Drawing Figures

TRANSFERRING PACKETS

Figure 1:
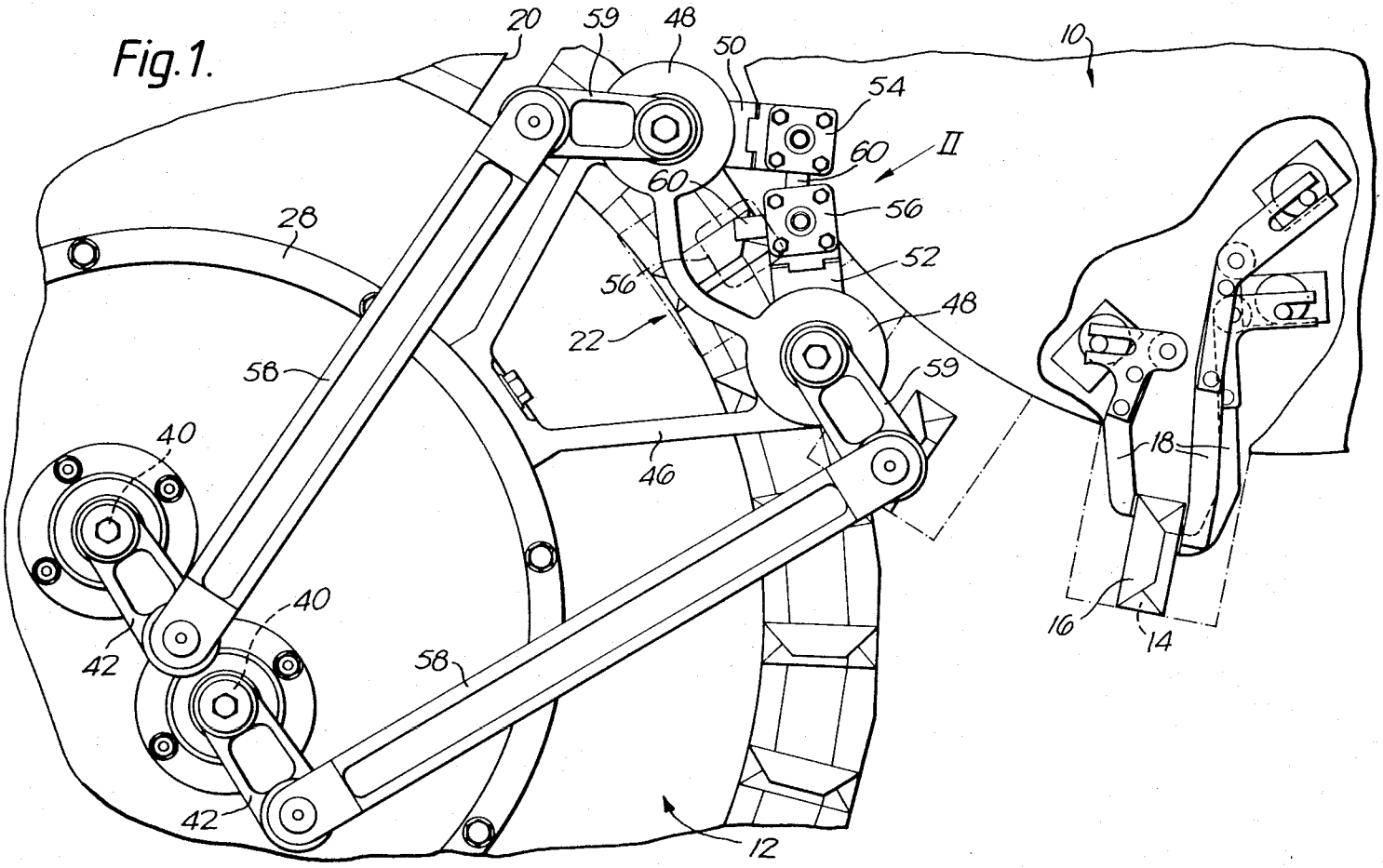

This invention is concerned with apparatus for transferring packets, in particular packets of cigarettes known as soft packs.

Packing machines for producing soft packs are commonly based on the principle of folding the wrapping material for the packs into a tubular shape around a series of hollow open-ended arbors or mandrels into each of which a group of cigarettes to be packed is inserted. The wrapping material at the free end of each mandrel is next folded and secured by adhesive to form the bottom end of the pack; and the pack is then transferred from the mandrel to a pocketed drying conveyor by pushing the cigarettes out through the mandrel so that they engage the inside of the folded bottom end and separate the wrapping material from the mandrel. While the pack is in the pocketed conveyor its other end is folded, and drying of adhesive between the other folds is completed. An example of such a packing machine is described in the specification of U.S. Pat. No. 4,330,976 issued May 25, 1982 to Blackall et al.

At the currently high speeds required of such machines a problem may arise in transferring successive packs from their mandrels, in that the adhesive at said bottom folded end may not have set sufficiently to withstand the force which has to be applied through the group of cigarettes to separate the wrapping material from its mandrel. In extreme situations this could lead to bursting open of said bottom folded end.

It has been proposed U.S. Pat. No. 4,241,564 to Rodolfo to slip off the wrapping material from the mandrel by various means which avoid contact between the cigarette group and the inside of the folded end of the packet. However it is believed that such proposals may lead to other difficulties.

According to the present invention there is provided apparatus for transferring successive packets with folded ends (e.g. soft packs of cigarettes) into adjacent axially extending pockets each of which is open at its axial ends and at one side, comprising a pusher for pushing each packet into a pocket with its folded end leading, and a pair of restraining devices operable alternately from opposite said pusher to engage the folded ends of successive packets, each restraining device having means for pivoting the device, so that in operation it enters each alternate pocket transversely at said one side and is caused to pass axially through the pocket while restraining said folded end of a packet during transfer thereof.

Such an arrangement is particularly suited to a packing machine in which said pockets are disposed in the periphery of an indexable drying means, the packets being transferred from successive hollow mandrels of a packet forming drum which is indexable in timed relation with the drying drum. Each restraining device may comprise an extensible pneumatic cylinder and an adjustable air restrictor to vary the resistance offered by the cylinder when being retracted during engagement by each packet being transferred; and the means for pivoting each restraining device may comprise an arm pivotally carrying each cylinder, and cam means to move each arm into or out of a pocket. Conveniently the cam means comprises a conjugal cam coaxial with the drying drum and rotatable once for each full cycle of operations of both pair of restraining devices.

Figure 2:
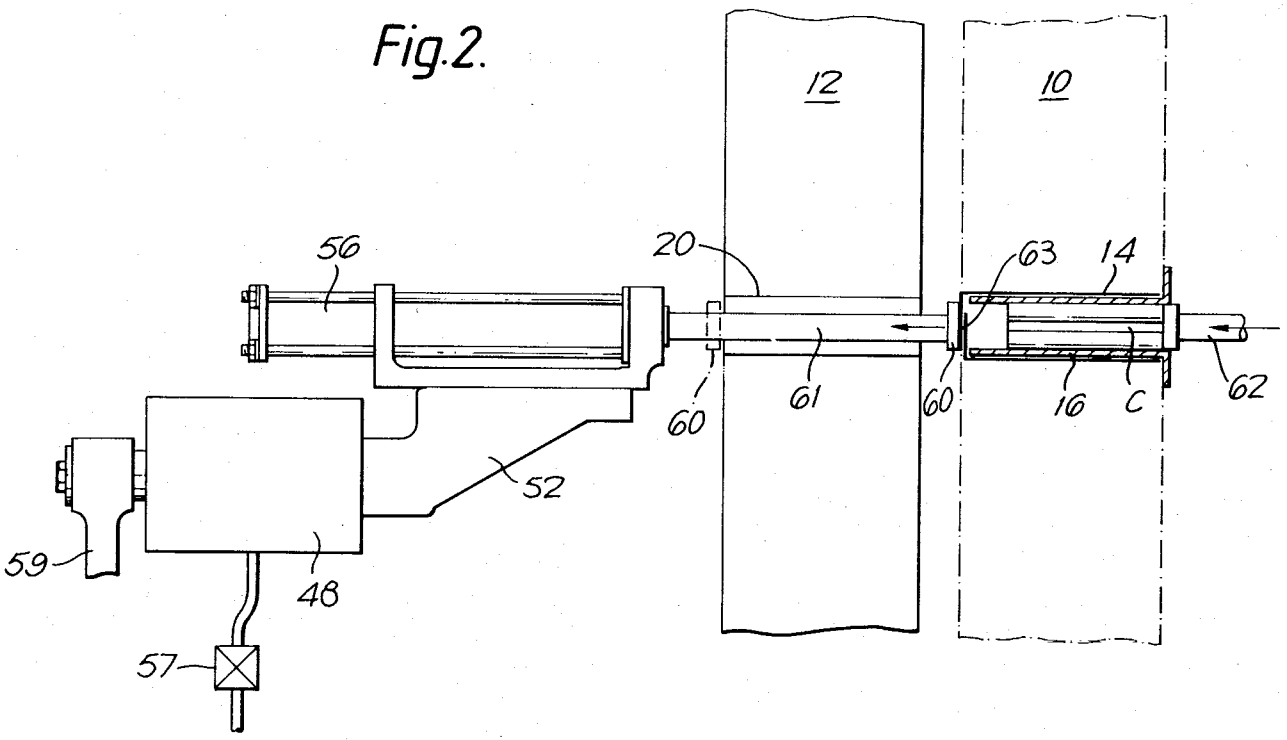
Figure 3:
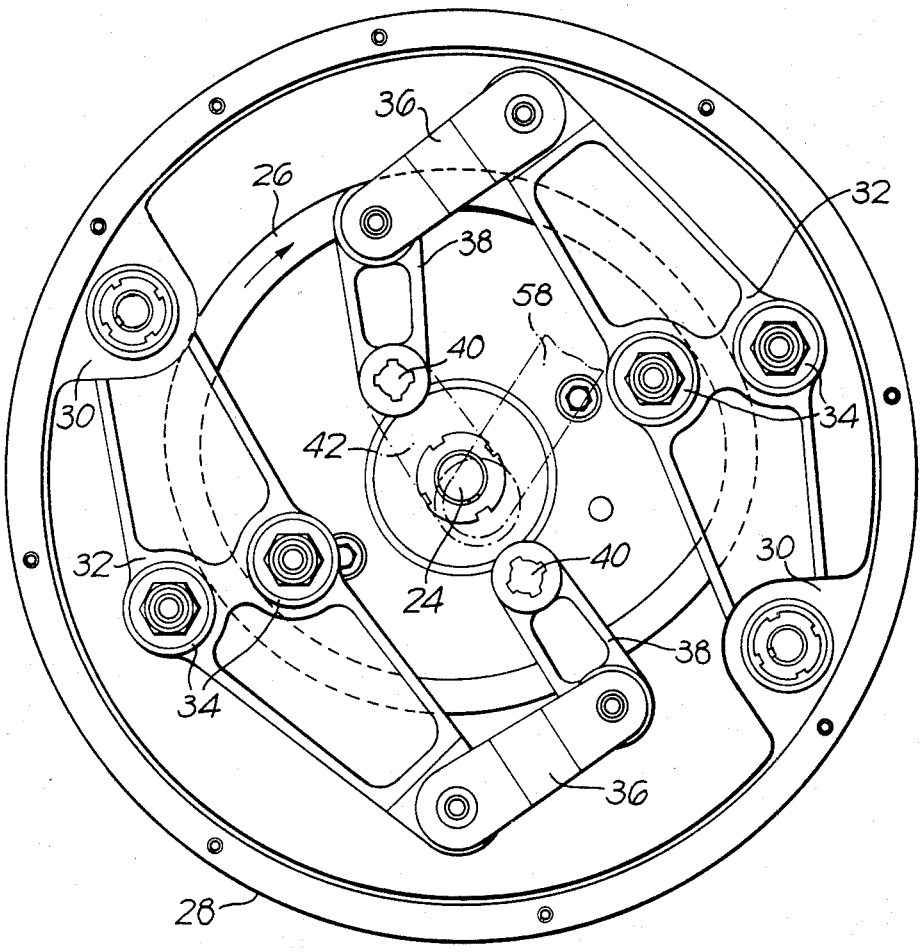
Figure 4:
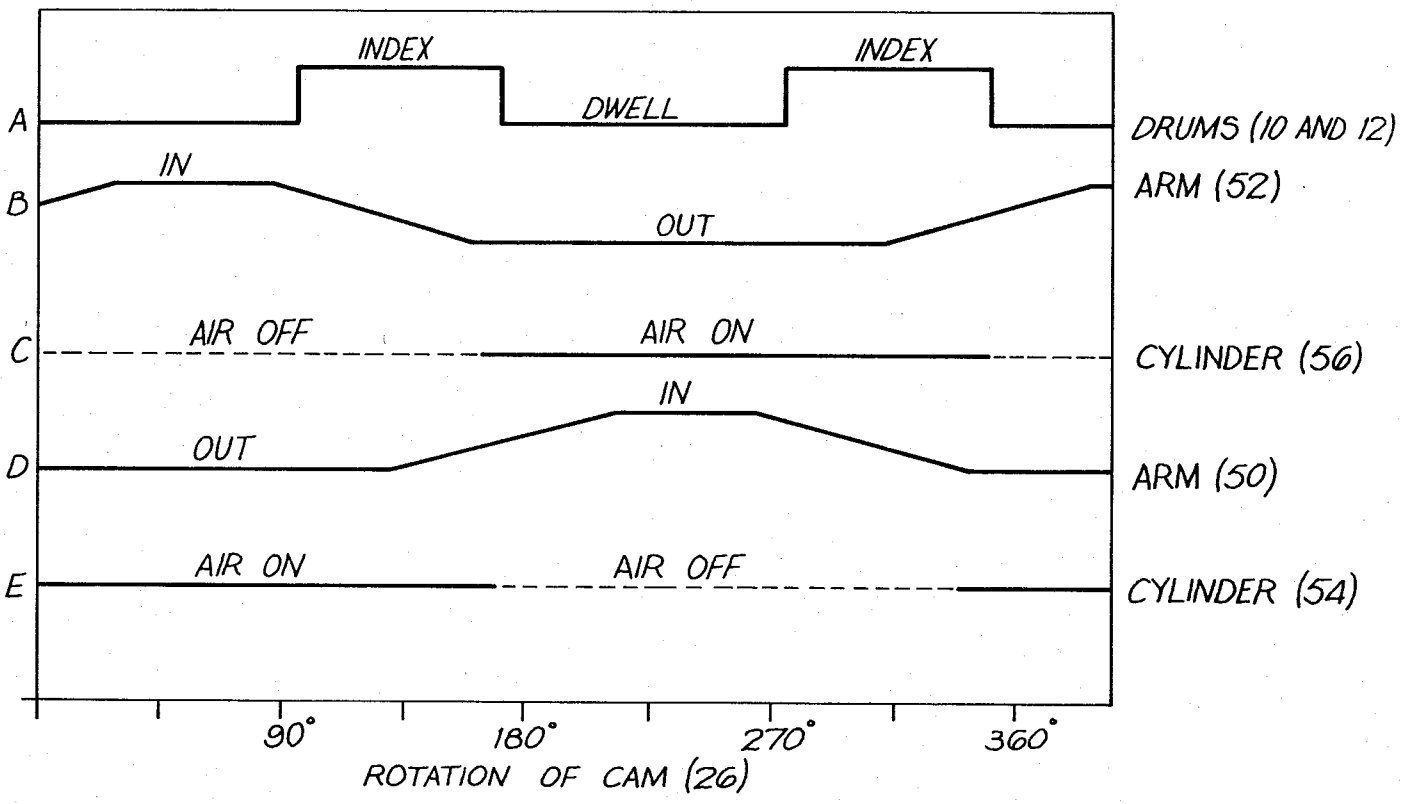

The invention will now be described, by way of example only, with reference to the accompanying drawings in which:

FIG. 1 is a front view of part of a packing machine embodying apparatus in accordance with the invention, FIG. 2 is a side view of part of the apparatus of FIG. 1 taken in the direction of arrow II, FIG. 3 is a front view of the interior drive mechanism of FIG. 1, and FIG. 4 is a timing diagram of various operating parts of the apparatus.

Referring first to FIGS. 1 and 2, there is shown part of a machine for packing cigarettes in soft packs, including a pack forming drum 10 and a drying drum 12. As more fully described in the above mentioned U.S. Pat. No. 4,330,976 to Blackall et al, the drum 10 comprises a plurality of rectangular hollow mandrels 14 around each of which a packet 16 is formed. To assist in holding the packing materials against the mandrel, there are provided three clamping arms 18, whose operation is more fully described, with reference to FIG. 4, in U.S. Pat. No. 4,330,976 to Blackall et al.

The drying drum 12 has a plurality of pockets 20 in its circumference, each pocket being open at its axial ends and at its radially outer side. The drum 12 is indexable in timed relation with indexing steps of the pack forming drum 10, so that at a transfer station 22 where the two drums overlap, a packet may be transferred from drum 10 to a pocket 20 of drum 12.

The drum 12 rotates intermittently about an axis 24 shown in FIG. 3; and coaxial therewith, but driven separately and continuously, is a conjugate cam 26. A circular fixed casing 28, also coaxial with the drum 12, carries two lugs 30 at diametrically opposed positions. From each lug 30 is pivoted an arm 32 carrying a pair of cam follower rollers 34 which engage with opposite tracks of the conjugate cam 26. The ends of the arms 32 remote from the lugs 30 are each connected by links 36 to cranks 38. At the pivoting point of each crank 38 there is formed a female spline 40 into which fits a splined shaft (not shown) secured to a respective actuating arm 42, shown in FIG. 1 (the upper one of the arms 42 being also shown chain-dotted in FIG. 3).

Mounted on the circular casing 28 at the transfer station 22 is a sub-frame 46, which carries a pair of bearings 48. Pivotally mounted from the bearings 48 are arms 50 and 52 at whose ends are carried pneumatic cylinders 54 and 56 respectively. Pivotal movement is imparted to the arms 50 and 52 (and thus to the cylinders) by the actuating arms 42 operating through connecting links 58 upon cranks 59 fixed to the arms 50 and 52. Thus upon rotation of the cam 26 the arms 50 and 52 alternately move the cylinders from an outer position, as occupied by cylinder 54, to an inner position, as shown chain-dotted for cylinder 56 in FIG. 1.

Referring to FIG. 2, where the cylinder 54 and associated parts have been omitted since they are similar to those of cylinder 56, the cylinder 56 is in fact shown in the inner position i.e. as shown chain-dotted in FIG. 1. The cylinder 56 (and likewise cylinder 54) is connected via an air control valve 57 to an air supply (not shown) to enable its piston rod 61 to be extended to its maximum position. The end of each rod 61 carries a pad 60 which is adapted to engage the folded flaps 63 formed at the end of a packet 16.

The operation of the apparatus will now be described in detail, referring also to the timing diagram of FIG. 4 which shows a full cycle of operations, i.e. two packet transfers. Line A indicates two indexing movements of the drums 10 and 12; lines B and D show the movement of arms 52 and 50 respectively; and lines C and E show the application of air pressure to the cylinders 56 and 54 respectively. The horizontal scale against which each of the lines A to E are drawn, represents a full 360° rotation of the cam 26.

Commencing with the ram 61 of cylinder 56 fully extended, in the position of the pad 60 shown in solid lines in FIG. 2, line B shows the arm 52 moving the cylinder 56 towards the inner position shown chain-dotted in FIG. 1. At this time the drums 10 and 12 are both stationary and a packet 16 formed on a mandrel 14 is waiting to be transferred to a pocket 20 in drum 22. Movement of the arm 52 thus causes the piston rod 61 of cylinder 56 to enter the pocket 20 through its open radially outer side, and allows the pad 60 to slide into engagement with the folded and sealed bottom end 63 of the packet 16 to be transferred. As shown by line C, the air pressure to cylinder 56 is off.

A pusher 62 (FIG. 2) now engages the filter ends of the group of cigarettes C within the mandrel 14. The pusher moves the cigarette group C along the mandrel so that its leading end meets the inside of the folded end 63; and further movement of the pusher 62 causes the group to move the folded end 63 against the pad 60 of the cylinder 56, whose resistance to inward movement can be varied by adjustment of an air restrictor (not shown) connected to outlet of the cylinder. Thus the folded end 63 of the packet 16 is firmly held between the pad 60 and the cigarette group C, and continued further movement of the pusher 62 causes the packet to begin sliding off and becoming separated from the mandrel 14 as it is transferred into the pocket 20 of the drying drum 12. When the pusher 62 has fully transferred the cigarette group (now surrounded by the packing material of the packet 16) into the packet 20, it is immediately and rapidly retracted back through the mandrel 14, and moves clear of the packet forming drum 10. The drum 10 then commences to index one step, as shown by line A, and the drum 12 also performs an indexing step, though of shorter distance.

As shown by the downwardly inclined portion of line B, a little time before the drums 10 and 12 commence this indexing movement the arm 52 starts moving radially outwards again. Even if the pad 60 were still partly in the pocket 20, outward movement of the arm 52 would ensure that the pad was withdrawn before indexing of the drum 12 commenced. The outward movement of the arm 52 can be seen by reference to FIG. 3, where continuous clockwise rotation of the conjugate cam 26 causes that arm 32 which is towards the left, as viewed in FIG. 3, to pivot clockwise; and via link 58 and crank 59 this movement brings the cylinder 56 outwards from its chain-dotted position.

Lines A and B show that shortly before indexing of the drums is completed, the arm 52 is in its fully outer position, whereupon air is supplied via the control valve 57 to the cylinder 56 (line C) to start extending the piston rod 61 again.

When the cylinder 56 on arm 52 has moved out beyond its halfway position, the cylinder 54 on arm 50 starts moving inwards, as shown by the upwardly inclined portion of line D. As soon as the drums 10 and 12 come to rest, the air supply to the cylinder 54 is disconnected via its control valve 57; thus when the cylinder 54 reaches its inner position, with its piston rod in the next pocket 20 of the drying drum 12, it is ready to restrain the folded bottom end of the next packet to be transferred, in the same manner as above described.

It will be seen that this arrangement enables the folded bottom end of each packet to be held firmly closed during transfer, in the relatively short time available at current high machine speeds.

I claim:

1. Apparatus for transferring packets, such as soft packs of cigarettes, each said packet having at least one folded end, comprising:

(a) means defining a plurality of adjacent pockets, each of which is open at its axial ends and at one side;

(b) a pusher for transferring each successive packet axially into a pocket through one of said open ends with said at least one folded end of the packet leading;

(c) a pair of restraining devices operable alternately in different pockets to engage said at least one folded end of each of said successive packets;

(d) means mounting each of said restraining devices for movement in a direction transverse to the axis of said pockets and for movement in a direction axially of said pockets; and (e) control means to alternately move each of said restraining devices in said transverse direction into alternate of said pockets through said one side thereof and for moving said devices axially in said pockets;

(f) whereby as said pusher transfers each successive packet through one of said open ends of a pocket said at least one folded end of said packet engages one of said restraining devices which is thereby caused to pass axially through said pocket while restraining said folded end during transfer thereof.

2. Apparatus for transferring packets, such as soft packs of cigarettes, each said packet having at least one folded end, comprising:

(a) means defining a plurality of adjacent pockets, each of which is open at its axial ends and at one side;

(b) a pusher for transferring each successive packet axially into a pocket through one of said open ends with said at least one folded end of the packet leading;

(c) a pair of restraining devices operable alternately in different pockets to engage said at least one folded end of each of said successive packets;

(d) means mounting each of said restraining devices for pivotal movement in a direction transverse to the axis of the pockets about an axis parallel to the axis of said pockets and for movement in a direction axially of said pockets; and (e) control means to alternately pivot each of said restraining devices into alternate of said pockets through said one side thereof and for moving said devices axially in said pockets;

(f) whereby as said pusher transfers each successive packet through one of said open ends of a pocket said at least one folded end of said packet engages one of said restraining devices which is thereby caused to pass axially through said pocket while restraining said folded end during transfer thereof.

3. Apparatus as claimed in claim 2 in which said pockets are disposed in the periphery of an indexable drying drum, the packets being transferred from successive hollow mandrels of a packet forming drum which is indexable in timed relation with the drying drum.

4. Apparatus as claimed in claim 2 in which said mounting means comprises an extensible pneumatic cylinder and an adjustable air restrictor to vary the resistance offered by the cylinder while restraining said at least one folded end of said packet during transfer.

5. Apparatus as claimed in claim 3 in which said control means for pivoting each restraining device comprises an arm pivotally carrying each cylinder, and cam means to move each arm into or out of a pocket.

6. Apparatus as claimed in claim 5 in which said cam means comprises a conjugal cam coaxial with the drying drum and rotatable once for each full cycle of operations of both of said restraining devices.

* * * * *